US008650791B2

(12) United States Patent
Williams

(10) Patent No.: US 8,650,791 B2
(45) Date of Patent: Feb. 18, 2014

(54) MULTI-PURPOSE TOOL

(75) Inventor: Nicholas Williams, Turin, NY (US)

(73) Assignee: The Otis Patent Trust, Lyons Falls, NY (US)

( * ) Notice: Subject to any disclaimer, the term of this patent is extended or adjusted under 35 U.S.C. 154(b) by 913 days.

(21) Appl. No.: 12/687,979

(22) Filed: Jan. 15, 2010

(65) Prior Publication Data

US 2011/0173862 A1 Jul. 21, 2011

(51) Int. Cl.
*F41C 23/00* (2006.01)

(52) U.S. Cl.
USPC ..... 42/72; 42/94; 42/90; 42/106

(58) Field of Classification Search
USPC ..... 42/72, 94, 90, 106
See application file for complete search history.

(56) References Cited

U.S. PATENT DOCUMENTS

| | | | | |
|---|---|---|---|---|
| 753,456 | A | 3/1904 | Weidinger | |
| 878,197 | A | 2/1908 | Fisher | |
| 1,048,937 | A | 12/1912 | Brightwell | |
| 1,426,265 | A | 8/1922 | Elenchuk | |
| 1,483,527 | A | 2/1924 | Starc | |
| 1,505,510 | A | 8/1924 | Uhl | |
| 1,556,755 | A | 10/1925 | Burman | |
| 2,173,215 | A | 9/1939 | Shover | |
| 2,606,471 | A | 8/1952 | Kollweck | |
| 3,040,420 | A | 6/1962 | Kulp | |
| 3,132,550 | A | 5/1964 | Sion | |
| 4,744,272 | A | 5/1988 | Leatherman | |
| 5,079,977 | A | 1/1992 | Petrie | |
| 5,542,167 | A * | 8/1996 | Nakamoto | 29/229 |
| 5,664,274 | A | 9/1997 | Collins | |
| 6,023,805 | A | 2/2000 | Lin | |
| 6,108,845 | A * | 8/2000 | Hung et al. | 7/128 |
| 6,226,822 | B1 | 5/2001 | Chen | |
| 6,347,565 | B2 | 2/2002 | Steinweg | |
| 6,386,076 | B1 | 5/2002 | Swanstrom, Jr. | |
| 6,532,846 | B2 * | 3/2003 | Lin | 81/177.2 |
| 6,643,877 | B1 | 11/2003 | Amtenbrink et al. | |
| 6,647,835 | B1 * | 11/2003 | Tseng | 81/423 |
| 6,707,007 | B1 | 3/2004 | Siddoway | |
| 6,721,983 | B2 * | 4/2004 | Dallas et al. | 7/128 |
| 6,732,617 | B2 | 5/2004 | Steinweg et al. | |
| 6,769,331 | B2 | 8/2004 | Berg et al. | |
| 6,792,835 | B1 | 9/2004 | Quick et al. | |
| 6,983,506 | B1 * | 1/2006 | Brown | 7/168 |
| 7,111,424 | B1 | 9/2006 | Moody et al. | |
| 7,140,279 | B2 | 11/2006 | Hernandez, Jr. | |
| 7,178,431 | B2 * | 2/2007 | Hsien | 81/177.2 |
| 7,210,230 | B2 * | 5/2007 | Wurzel | 30/260 |
| 7,409,791 | B2 | 8/2008 | Moody et al. | |
| 7,412,793 | B2 | 8/2008 | Moody et al. | |
| 7,421,815 | B1 | 9/2008 | Moody et al. | |
| 7,497,150 | B1 * | 3/2009 | Huang | 81/423 |
| 7,793,454 | B1 * | 9/2010 | Beltz | 42/94 |
| 7,814,817 | B1 * | 10/2010 | Sheriff | 81/423 |

(Continued)

*Primary Examiner* — Michelle Clement
(74) *Attorney, Agent, or Firm* — Harris Beach PLLC

(57) ABSTRACT

Embodiments of the present invention comprise a tool that can be configured for use as the grip of a firearm. In one embodiment, the tool comprises a handle part and a tooling part coupled to the handle part. The tooling part can be configured to receive one or more end effectors. The handle part can comprise one or more elongated sections on which are disposed a handle body, where in one construction the elongated sections are interleaved in a manner that permits the handle body to move amongst a plurality of working configurations.

18 Claims, 13 Drawing Sheets

(56) References Cited

U.S. PATENT DOCUMENTS

| | | | | |
|---|---|---|---|---|
| 7,823,855 | B2 * | 11/2010 | Faifer | 248/440.1 |
| 7,909,301 | B2 * | 3/2011 | Faifer | 248/440.1 |
| 8,225,543 | B2 * | 7/2012 | Moody et al. | 42/72 |
| 8,316,549 | B2 * | 11/2012 | Musser | 30/260 |
| 2005/0188596 | A1 * | 9/2005 | Wygant | 42/94 |
| 2005/0188597 | A1 * | 9/2005 | Keng et al. | 42/94 |
| 2006/0027053 | A1 * | 2/2006 | Hsien | 81/177.2 |
| 2006/0278797 | A1 * | 12/2006 | Keng et al. | 248/440.1 |
| 2009/0038200 | A1 * | 2/2009 | Keng | 42/94 |
| 2010/0326248 | A1 * | 12/2010 | Owoc | 81/177.2 |
| 2011/0126444 | A1 * | 6/2011 | Keng et al. | 42/94 |

* cited by examiner

A–A

B–B

C–C

DETAIL D

E–E

F–F

MULTI-PURPOSE TOOL

TECHNICAL FIELD

The present invention relates to hand tools, and more particularly, in one embodiment to hand tools with features configurable for use as an accessory to a firearm.

BACKGROUND

Hand tools with multiple implements can eliminate the need for a collection of conventional tools. This configuration may benefit those users who have only an infrequent need for certain tools, which would not warrant carrying those tools in their regular, full-size form. This configuration can also benefit those users, such as the sportsman, outdoorsman, and military personnel, for whom the reduction in size and weight of tooling (and related tool kits) without the loss of functionality (e.g., multiple tooling configurations) is particularly important for service tasks, maintenance tasks, and particular usages related to a firearm.

Many types of multi-purpose and configurable tools are known. Each type, however, is not without its particular limitations. Moreover, when discussed in relation to firearms and related weaponry, many of these know devices are not configured for implementation as part of or as an accessory to a firearm.

There is therefore a need for a tool, and more particularly a configurable tool, which is compatible with portions of the firearm.

SUMMARY

There is provided below embodiments of a tool, and a tool kit, that can be configured for use with a firearm. In one embodiment, a tool for receiving an end effector can comprise first and second elongated handle portions comprising a primary tubular member, a secondary tubular member inside of the primary tubular member, and a grip portion secured to the primary tubular member. The tool can also comprise an end effector receiving portion coupled to each of the first and second elongated handle portions, as well as a pivot coupling the end effector receiving portions in a manner effectuating rotation of the end effector receiving portions about the pivot in response to movement of the first elongated handle portion with respect to the second elongated handle portion. The tool can be further described wherein the grip portion comprises a bottom surface located a distance from the pivot, wherein the secondary tubular member is moveable with respect to the primary tubular member to permit the grip portion to move to a first position and a second position, and wherein the distance between the bottom surface and the pivot in the first position is different from the distance between the bottom surface and the pivot in the second position.

In another embodiment, a hand grip for a firearm can comprise a handle body comprising first and second grip portions, and a pair of elongated handle members each supporting one of the first and second grip members, where the elongated handle members can comprise interleaved sections with an inner interleaved section and an outer interleaved section. The hand grip can also comprise an end effector receiving portion secured to the inner interleaved section, and a pivot coupling each of the end effector receiving portions in a manner effectuating rotation of the end effector receiving portions about the pivot in response to movement of the elongated handle members. The hand grip can be further defined wherein the first and second grip portions comprise a bottom surface located a distance from the pivot, and wherein the first interleaved section is moveable with respect to the second interleaved section to permit the first and second grip portions to move to a first position and a second position, and wherein the distance between the bottom surface and the pivot in the first position is different from the distance between the bottom surface and the pivot in the second position.

In yet another embodiment, a tool kit can comprise a tool that comprises a tool part comprising a first end effector receiving portion, a second end effector receiving portion, and a pivot rotatably coupling the first end effector receiving portion and the second end effector receiving portion. The tool can also comprise a handle part coupled to the tool part, the handle part comprising a first handle portion and a second handle portion, one each coupled to the first and second end effector receiving portions in a manner effectuating rotation of the first and second end effector receiving portions about the pivot in response to movement of the first handle portion with respect to the second handle portion. The tool can be further defined wherein each of the first and second handle portions comprise a handle body that has a bottom surface located a distance from the pivot, and wherein the handle body is moveable to a first position and a second position so that the distance between the bottom surface and the pivot in the first position is different from the distance between the bottom surface and the pivot in the second position. The tool kit can also comprise an end effector comprising an end effector adapter end for engaging an engagement feature of the end effector receiving portions. The end effector can be further defined wherein the end effector comprises a working end operative for one or more implementations.

BRIEF DESCRIPTION OF THE DRAWINGS

So that the manner in which the above recited features of the present invention can be understood in detail, a more particular description of the invention briefly summarized above, may be had by reference to the embodiments, some of which are illustrated in the accompanying drawings. It is to be noted, however, that the appended drawings illustrate only typical embodiments of this invention and are therefore not to be considered limiting of its scope, for the invention may admit to other equally effective embodiments. Moreover, the drawings are not necessarily to scale, emphasis generally being placed upon illustrating the principles of certain embodiments of invention.

Thus, for further understanding of the concepts of the invention, reference can be made to the following detailed description, read in connection with the drawings in which.

DETAILED DESCRIPTION

With reference to the drawings, in general, and FIGS. 1-18 in particular, there is described herein embodiments of a tool that can be configured to accommodate a variety of implementations. Embodiments of the tool can provide a platform on which can be attached a variety of end effectors such as, but not limited to, pliers, screwdrivers, wrenches, hammers, knives, wire cutters, bolt cutters, and pinschers. Moreover, as will become evident from the discussion below, tools that are constructed using the concepts disclosed herein can also provide a gripping mechanism ("grip") and/or handle, the likes of which can be used in connection with firearms and related weaponry.

Exemplary constructions of the tool, for example, can be provided with one or more end effectors that are compatible with, e.g., the Picatinny rail ("rail") of an M16A4 rifle. In one embodiment, the end effector can be secured or otherwise coupled to the rail of the rifle so that the tool provides the user with a forward hand grip. Constructions and embodiments of the tool can also permit the tool to provide at least one balancing surface at a location suited to support and steady the front portion of the rifle. The tool, for example, can be constructed so that when used as the forward hand grip, the tool can elongate, and in one particular example the tool can extend in a direction away from the rail of the rifle. It is further contemplated that portions of the tool can also separate to provide a plurality of balancing surfaces that support the front portion of the rifle. All of these features are beneficial because tools of the type disclosed and described herein, either alone or as part of a kit that comprises the tool and one or more end effectors, can replace existing tools, tool kits, stands (e.g., bi-pods, tri-pods), and handgrips like those discussed in the Background above.

Figure 1:
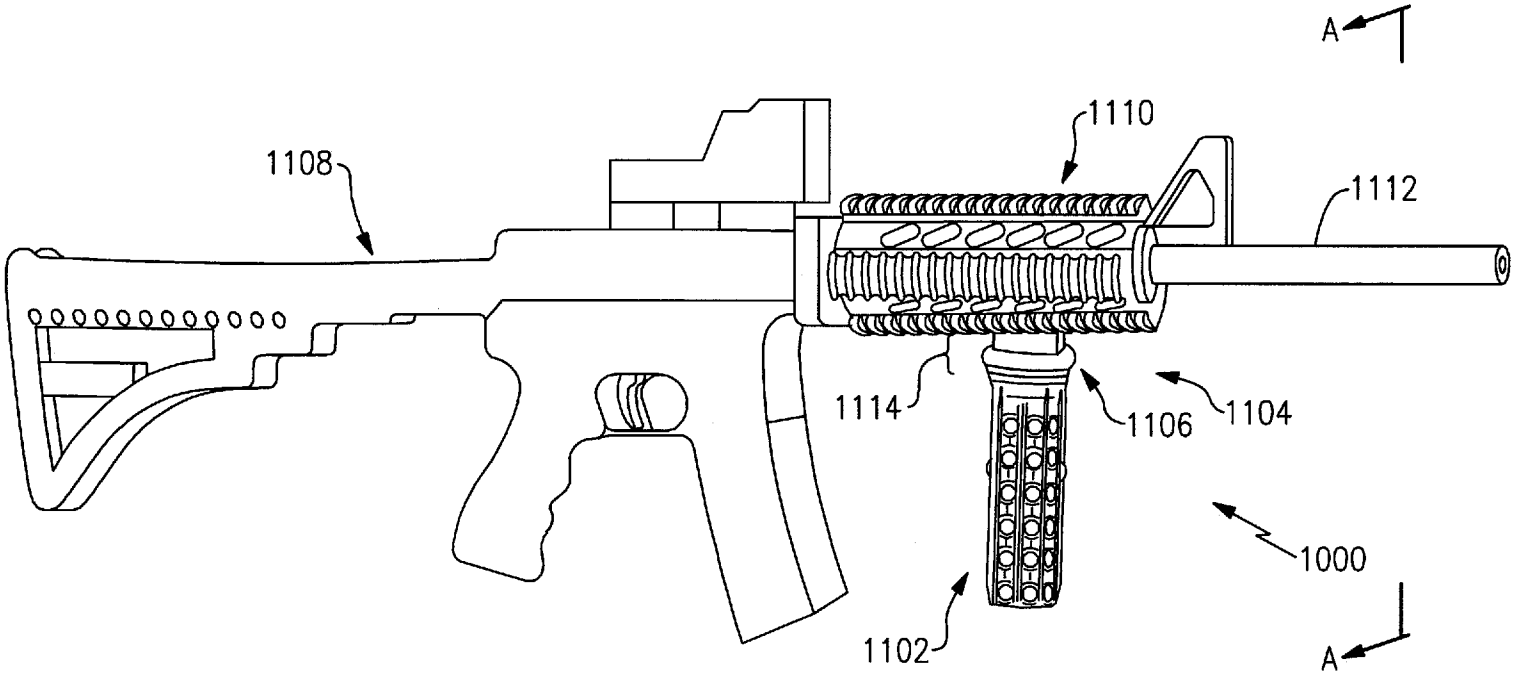
FIG. 1 is a side, perspective, assembly view of a firearm that includes an exemplary embodiment of a tool made in accordance with concepts of the present invention.

FIGS. 1-4 illustrate at a high level these concepts through an exemplary implementation of one embodiment of a tool 1000. There is shown in FIG. 1 that the tool 1000 can comprise a handle part 1102 and a tooling part 1104. The tooling part 1104 can comprise an end effector receiving end 1106, which in the present configuration is shown as being coupled to a firearm 1108, and more particularly to a rail 1110 on a barrel 1112 via an end effector 1114.

The handle part 1102 can be constructed variously from one or more pieces that interleave, overlap, or otherwise are interconnected. Embodiments the tool 1000 can be formed of such interleaved members in a manner that permits relative movement among one or more pieces of the construction. Examples of such pieces can be tubular members with cross-sections that fully and/or partially support consecutively smaller tubular members, the smaller tubular members being insertably received in the larger tubular members.

The handle part 1102 can likewise incorporate features that can permit and/or prevent relative movement such as the relative movement of the tubular members discussed above. These features can be mechanisms with individual components useful for securing together the tubular members. These mechanisms can be operated or actuated by hand to effectuate movement of the handle part 1102 relative to the tooling part 1104.

The tooling part 1104, and more particularly the end effector receiving end 1106, can be generally configured to receive and support the end effectors therein. These portions can comprise mechanisms and features that permit the end effector to be insertably coupled to the end effector receiving end 1106. In one example, features on the end effector and the end effector receiving end 1106 can work in conjunction to secure the end effector in place and to prevent such from being removed without, e.g., intervention by a user.

Figure 2:
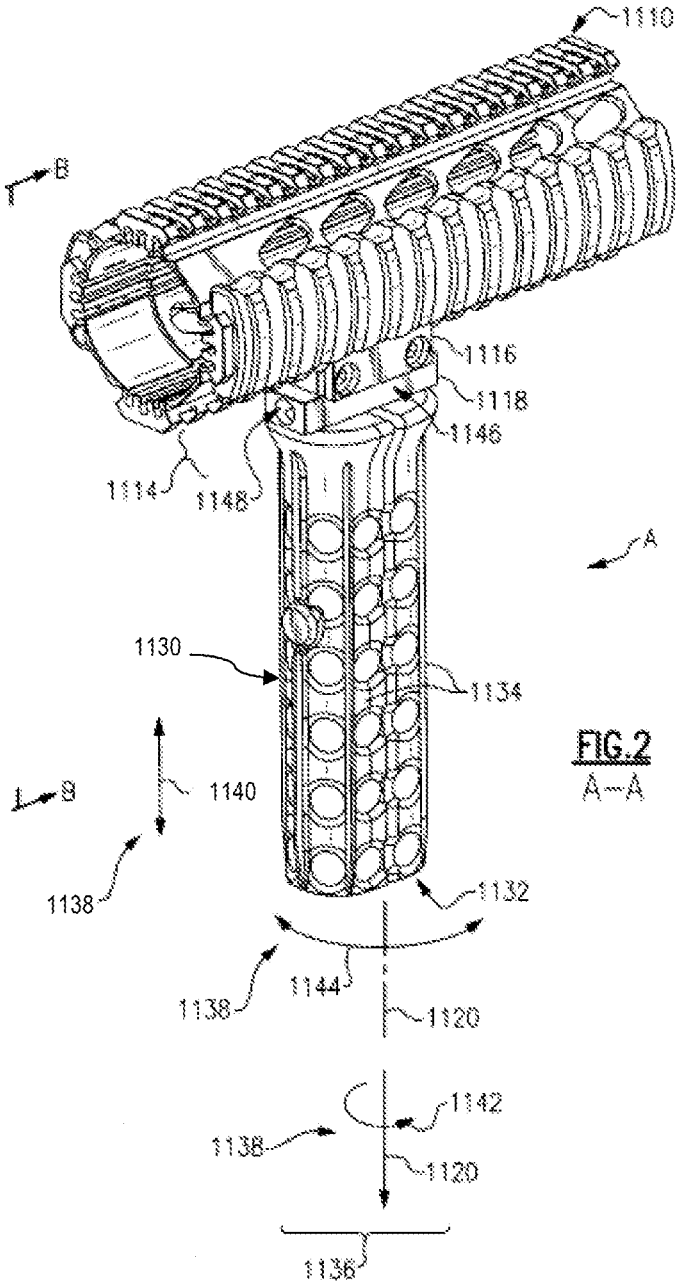
FIG. 2 is a side, perspective, assembly view of portions of the firearm and the exemplary embodiment of the tool of FIG. 1.
Figure 3:
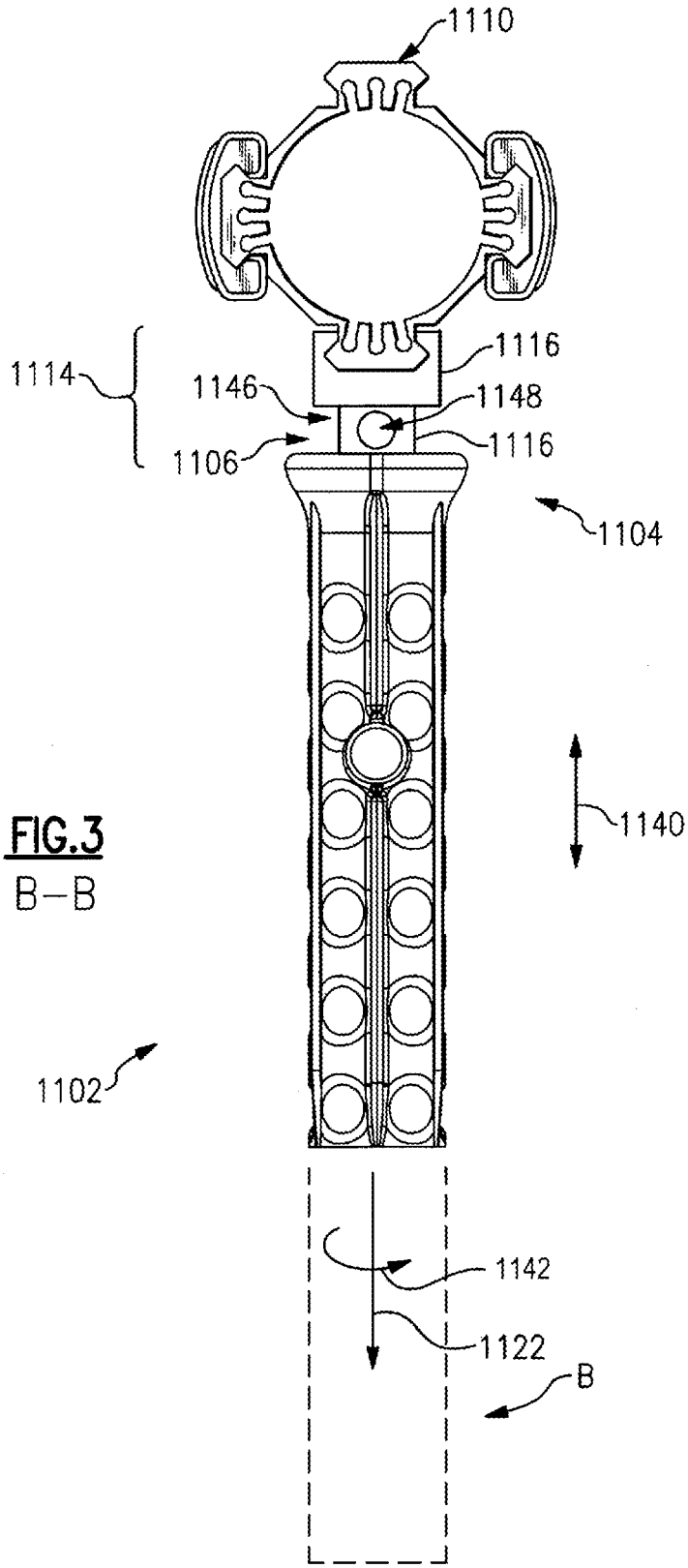
FIG. 3 is a front, assembly view of portions of the firearm and the exemplary embodiment of the tool of FIG. 1.
Figure 4:
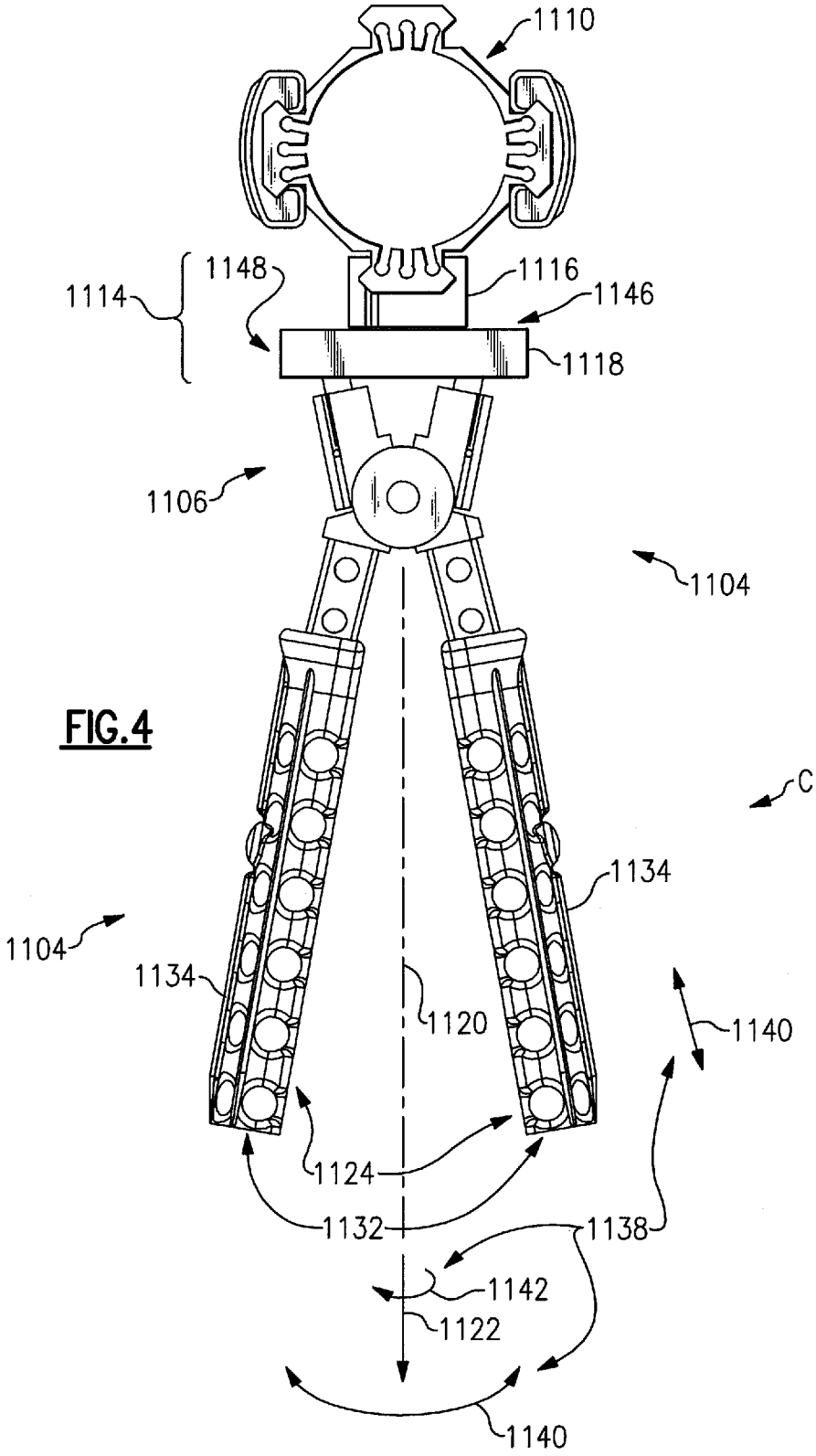
FIG. 4 is a front, assembly view of portions of the firearm and the exemplary embodiment of the tool of FIG. 1.

Referring now to the illustrations of FIGS. 2-4, in which parts of the firearm 1108 save for the rail 1110 are removed for clarity, there is shown in the present example that the end effector 1114 can comprise a rail interface 1116 and a tool interface 1118, the combination of which being so configured for relative movement (e.g., rotation) as between these two components. The tool 1000 can also comprise a midline 1120, a longitudinal axis 1122, and a pair of a handle portions 1124 formed about the midline 1120. Each of the handle portions 1124 can comprise a release mechanism 1130, a support surface 1132, and a gripping surface 1134, with one construction of the tool 1000 being provided in which the gripping surface 1134 is substantially symmetrical about the midline 1126 to provide a grip 1136 with ergonomic features consistent with, e.g., clasping of the forward hand grip by a hand of a user.

The components of the tool 1000 can be designed and assembled so that the tool 1000 can have a plurality of degrees of freedom 1138. These degrees of freedom 1138 can comprise translation 1140, rotation 1142, and angular displacement 1144 as shown in the tool 1000 of FIGS. 2-4. The degrees of freedom 1138 can permit the handle part 1102 to be adjusted amongst a plurality of working configurations. Exemplary working configurations for the handle part 1102 are illustrated in the present example as a hand grip configuration A (FIG. 2), an extended hand grip configuration B (FIG. 3), and a bi-pod configuration C (FIG. 4).

The translation 1140 can be effectuated as movement of the handle part 1102, and more particularly as movement of one or more of the handle portions 1128 along the longitudinal axis 1122. The handle portions 1128 can move independently from the other so that each can be located at different positions along the longitudinal axis 1122 as desired. This feature is useful to change the handle part 1102 between the hand grip configuration A and the extended hand grip configuration B.

The rotation 1142 can be facilitated, in one embodiment of the tool 1000 by the type, design, and functionality of the end effector 1114. For example, as is generally shown in FIG. 3, the end effector 1114 can comprise a joint 1146 and joint release mechanism 1148 used for, respectively, securing the rail interface 1116 and the tool interface 1118, and permitting relative movement (e.g., rotation) between the rail interface 1116 and the tool interface 1118. The joint 1146 can be a rotary joint, an example of which is illustrated as an end effector 4000E in FIGS. 17 and 18 below. The joint release mechanism 1148 can comprise any one of compressible springs and spring-like material, actuatable components, and other devices that can prevent and permit relative movement of the rail interface 1116 and the tool interface 1118 in response to, e.g., actuation by the user.

The angular displacement 1144 can be likewise effectuated by the selected configuration of the end effector 1114. As it is shown in FIG. 4, portions of the end effector 1114 such as the tool interface 1118 can be constructed to permit the handle portions 1128 to move relative to the midline 1126. This movement can permit the handle portions 1128 to be separated from one another, and in the present example there is shown such separation of the handle portions 1128 to form the bi-pod arrangement C. This configuration is also illustrated in the end effector 4000E and discussed in more detail below.

The inventors further note, and as discussed in the following embodiments of tools constructed using the concepts of the tool 1000, that the angular displacement 1144 of the handle portions 1128 can further effectuate movement of other parts of the tool 1000. This feature is beneficial for other examples of the end effector 1114, some of which may be designed for gripping and cutting implementations. Moreover, the translation 1140 of the handle portions 1128 can improve implementation of still other examples of the end effector 1114 such as screw drivers and hammers, both of which can benefit from the change in length of the tool 1000 as between, for example, the hand grip configuration A and extended hand grip configuration B. A more detailed discussion of these features is provided in connection with the exemplary embodiments of tools 2000 and 3000 that are illustrated in FIGS. 5-12 and discussed in detail below.

To further exemplify and describe the concepts of the present invention in more detail, reference can now be had to the embodiment of the tool 2000 that is illustrated in FIGS. 5-9. The tool 2000 can comprise a handle part 2102 and a tooling part 2104, which is coupled to the handle part 2102 as further described below. The tool 2000 is shown in an extended hand grip configuration, which similar to the extended hand grip configuration B of FIGS. 1-4 illustrated and described above. In the present example, the tooling part 2104 can comprise a pair of end effector receiving portions 2106 such as the first end effector receiving portion 2108 and the second end effector receiving portion 2110 that are illustrated in the present example. The tooling part 2104 can further comprise a pivot 2112 that couples together the end effector receiving portions 2106 to permit the first end effector receiving portion 2108 to rotate with respect to the second end effector receiving portion 2110.

The handle part 2102 can comprise a handle portion 2114 with a first handle portion 2116 and a second handle portion 2118 that are coupled to, respectively, the first end effector receiving portion 2108 and the second end effector receiving portion 2110. Each of the first handle portion 2116 and the second handle portion 2118 can comprise an elongated member 2120 that has an upper receiving area 2122 for interfacing with the tooling part 2104. The handle portion 2114 can also comprise a handle body 2124 in surrounding relation to at least a portion of the elongated member 2120. The handle body 2124 can comprise a release mechanism 2126 with an actuator 2128 and a depressible button 2130, the combination of which can be used for securing the position of the handle portion 2114 with respect to, e.g., the pivot 2112. The handle body can also comprise a support surface 2132, and a gripping surface 2134 with one or more indentations 2136 and an upper support surface 2138. In one embodiment, the gripping surface 2134 can form a grip 2140 that defines an opening 2142 when the first handle portion 2116 is immediately adjacent the second handle portion 2118, as is illustrated in the present example of FIG. 5.

The handle body 2124 can comprise one or more of a variety of materials. These materials can be compliant, resilient, and/or otherwise comfortable for handling with gloved and ungloved hands. Suitable materials can also be resistant to water, abrasives, and corrosive materials. A short sampling of exemplary materials can comprise plastics (e.g., TPE, sanoprene), rubber, metals (e.g., aluminum, stainless steel), and composites (e.g., carbon fiber), among many others.

The indentations 2136 are provided in the present example as dimples and deviations in the gripping surface 2134. These features can be of any size and shape relative to the overall surface area of the gripping surface 2134, with at least one construction of the tool 2000 being provided wherein the indentations 2136 are circular with a diameter of between about 5 mm and about 15 mm, and with a depth measured into the material of the handle body 2124 of greater than about 2 mm. The upper support surface 2138 can comprise one or more curved and/or curvilinear surfaces, which can be constructed to extend over the hand. These surfaces can be designed in a manner that helps to distribute the weight of the rifle more evenly about the upper surfaces of the hand when the user engages the grip 2140.

Figure 5:
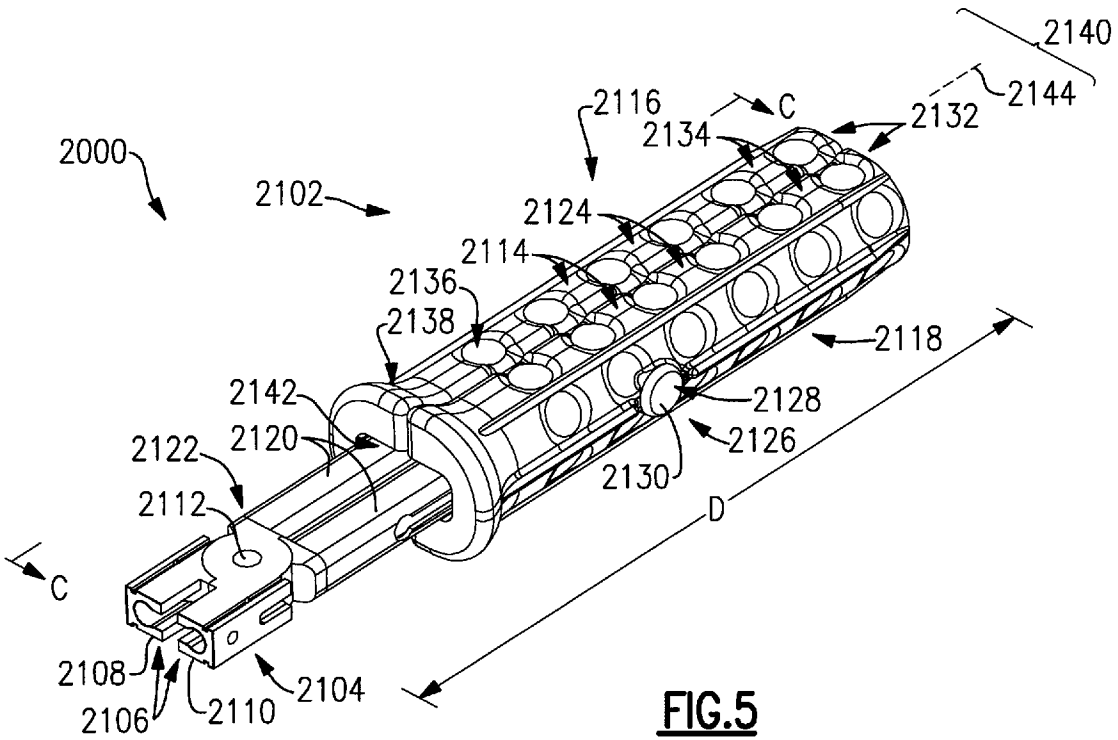
FIG. 5 is a top, perspective, assembly view of another exemplary embodiment of a tool made in accordance with concepts of the present invention.

The opening 2142 can be sized and shaped to receive the tooling part 2102. The opening 2142 can be oval-shaped, as it is illustrated in the example of FIG. 5, with a portion of the oval being formed on each handle body 2124 of the first handle portion 2116 and second handle portion 2118. Other shapes for the opening 2142 are contemplated so long as the dimensions of the relevant shape of the opening 2142 are such that it can receive the tooling part 2102 therein. In one embodiment, the tool 2000 can be configured so that the tooling part 2102 can be fully surrounded by the handle body 2124 in the hand grip configuration A (FIGS. 1-4), and in one example this configuration leaves exposed only that portion of the tooling part 2102 opposite the support surface 2132 of the handle body 2124.

Examples of the actuator 2128 can include, but are not limited to, buttons, slides, rotatable switches, thumbwheels, mechanical fasteners, and the like. In the embodiment that is illustrated in FIG. 5, the depressible button 2130 can be unitarily constructed as part of the handle body 2124 such as with compressible and/or malleable materials of construction for at least the area on the handle body 2124 proximate the actuator 2128. Other constructions of the tool 2000 could also incorporate one or more separate components for use as the release mechanism 2126, the actuator 2128, and the depressible button 2130. These components can couple the actuator 2128 to the elongated member 2120 to permit the user to release the handle body 2124 from its secured, non-moving configuration. Coupling the actuator 2128 and the elongated member 2120 can also permit movement of the handle body 2124 of one or both of the first handle portion 2116 and the second handle portion 2118.

In one embodiment of the tool 2000, the position of the handle body 2124 can be defined by a distance D that is measured from the pivot 2112 to the support surface 2132. Movement of the handle body 2124 can change the value of the distance D such as by changing the position of the handle body 2124 amongst the plurality of working configurations. These working configurations include the hand grip configuration A and the extended hand grip configuration B of FIGS. 1-2 in which the value of the distance D can have, respectively, its minimum value and its maximum value. Discussion of the working configurations was provided in connection with the implementation of one embodiment of the tool 1000 that was illustrated in FIGS. 1-4 and discussed above. In one example, actuating the actuator 2128 can permit the handle body 2124 to be positioned in any one of its working configurations, including the hand grip position A (FIGS. 1-4) and extended hand grip configuration B (FIGS. 1-4), as well as other positions at which the handle body 2124 of the first handle portion 2116 is in a different position than the handle body 2124 of the second handle portion 2118.

Figure 6:
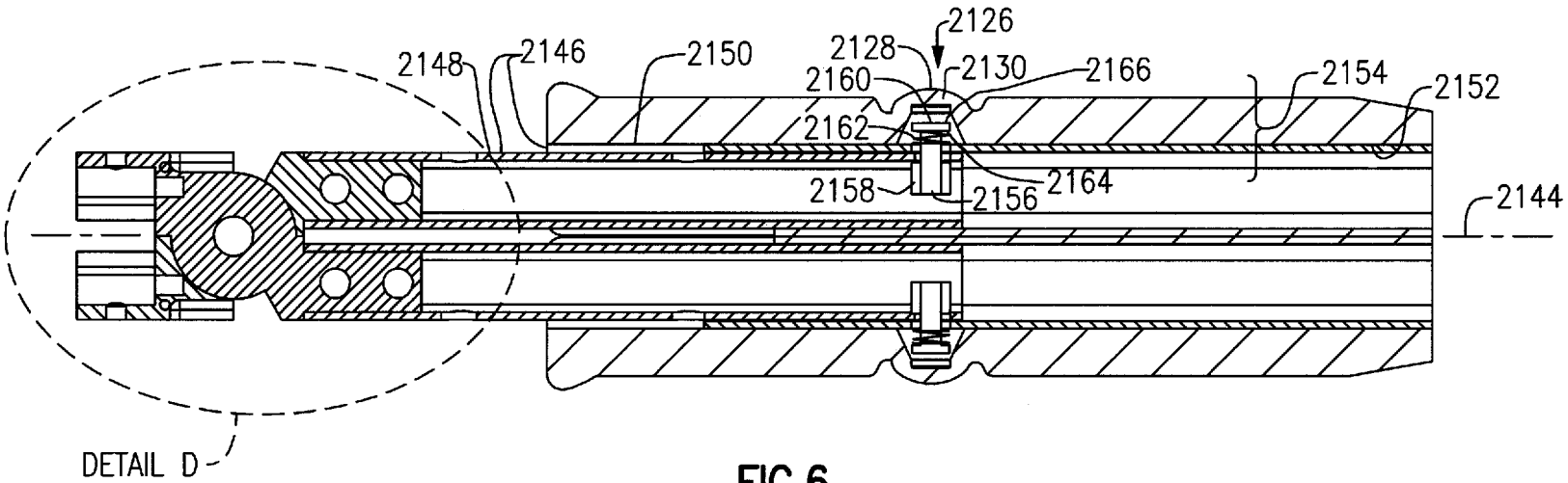
FIG. 6 is a side, cross-section, assembly view of the tool of FIG. 5.

Features of embodiments of the tools discussed herein are also shown in the cross-section of the tool 2000 in the illustration of FIG. 6. Here there is provided one embodiment of the tool 2000 that can comprise a midline 2144 and a pair of interleaved sections 2146 that are sized, shaped, and configured to move relative to one another. The interleaved sections 2146 can comprise an inner interleaved section 2148 and an outer interleaved section 2150, which can be in at least partial surrounding relation to the inner interleaved section 2148. The handle body 2124 for each of the interleaved sections 2146 can be provided with an interior handle bore 2152, which in one example can be sized and shaped to form a press, or interference fit with the outer surface of the outer interleaved section 2150. In another example, the handle body 2124 and the outer interleaved section 2150 can be coupled, e.g., by using adhesives or fasteners.

The configuration of the interleaved sections 2146 can permit the handle body 2124 of the first handle portion 2116 and the second handle portion 2118 to move independently of each other, such as was described above. The interleaved sections 2146 can comprise rigid materials such as metals (e.g., aluminum, steel, brass, stainless steel) and/or rigid plastics or composites (e.g., carbon fiber), and in one particular construction the interleaved sections 2146 are manufactured as tubular members with an inner bore defined by a outer, substantially contiguous cross-section of the rigid material.

The tool 2000 can also comprise a section locking mechanism 2154 that can form part of the release mechanism 2126 such as by being coupled to the actuator 2128. By way of non-limiting example, it is shown in the 2000 of FIG. 5 that the section locking mechanism 2154 can comprise a locking pin 2156, a lower pin retainer 2158, an upper pin retainer 2160, and a biasing spring 2162, which can be a compression spring disposed over the locking pin 2156. In one example, the biasing spring 2162 can comprise a lower surface 2164 in contact with the outer interleaved section 2150, and an upper surface 2166 in contact with the upper pin retainer 2160.

The lower pin retainer 2158 and the upper pin retainer 2160 can be dimensionally larger than the locking pin 2156. It may be desirable, for example, that the locking pin 2156, the lower pin retainer 2158, and the upper pin retainer 2160 are cylindrical, wherein the diameters of the lower pin retainer 2158 and the upper pin retainer 2160 are larger than the locking pin 2156. Each of these components can be manufactured separately and assembled together to form the section locking mechanism 2154. In one embodiment of the tool 2000, one or more of these components can be unitarily constructed to limit the number of components required in the assembly.

The section locking mechanism 2154 can be generally configured to regulate the relative movement of the inner interleaved section 2148 with respect to the outer interleaved section 2150. In one example, actuation of the actuator 2128 can disengage (or unlock) the section locking mechanism 2154 to permit relative movement of the inner interleaved section 2148 and the outer interleaved section 2150. This relative movement can, in turn, permit the handle body 2124 to move amongst the plurality of working configurations including the hand grip configuration A and the extended hand grip configuration B discussed above.

In one embodiment, the locking pin 2156 can extend through both of the inner interleaved section 2148 and the outer interleaved section 2150. The lower pin retainer 2158 can be coupled to the locking pin 2156 proximate the interior portion of the inner interleaved section 2148. The upper pin retainer 2160 can be coupled on the side of the locking pin 2156 opposite the lower pin retainer 2158 so the upper pin retainer 2160 is proximate the actuator 2128. The biasing spring 2162 can exert an axial spring force away from the midline 2144. This force can cause the lower pin retainer 2158 to engage (or lock) one or both of the inner interleaved section 2148 and the outer interleaved section 2150.

In one example, this engagement is provided by a recess (es) or opening(s) (not shown) in both of the interleaved sections 2146 through which the lower pin retainer 2158 can extend between the interleaved sections 2146. Actuation of the actuator 2128, however, such as by imparting an axial force opposite (and greater than) the spring force (i.e., by depressing the actuator 2128 towards the midline 2144 of the tool 2000), will force the lower pin retainer 2158 towards the midline 2144. This action can disengage the lower pin retainer 2158 from one or both of the interleaved sections 2146, and permit relative movement as between the inner interleaved section 2148 and the outer interleaved section 2150. By removing the force from the actuator 2128, the biasing spring 2162 rebounds and causes the lower pin retainer 2158 to reengage the inner interleaved section 2148 and the outer interleaved section 2150.

Figure 7:
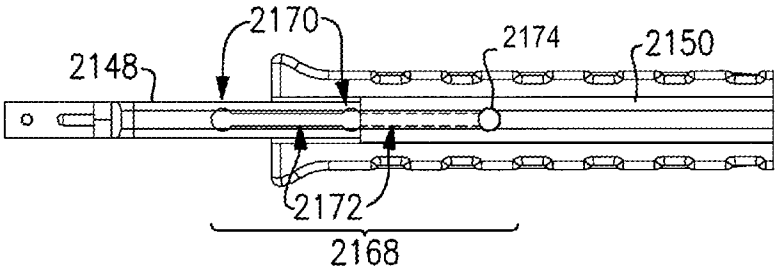
FIG. 7 is a top, partial assembly view of the tool of FIG. 5.
Figure 8:
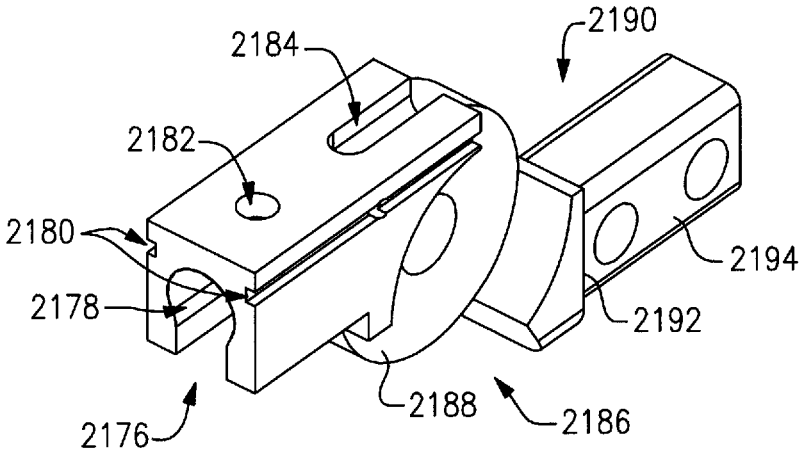
FIG. 8 is a side, perspective view of an end effector receiving portion for use with the tools such as the tools of FIGS. 1-7.
Figure 9:
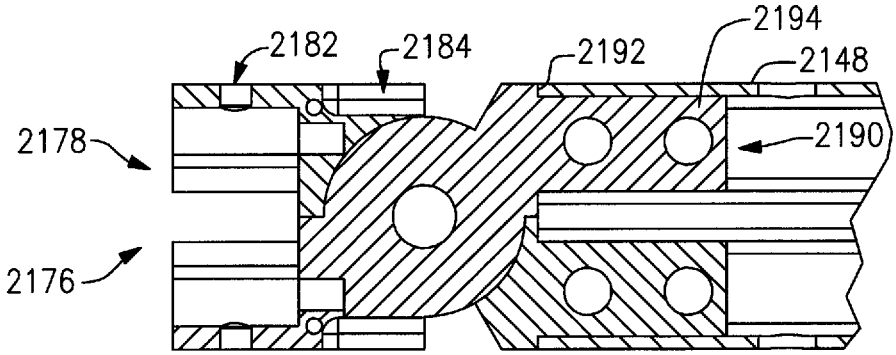
FIG. 9 is a detail view of the tool of FIG. 6.

To further exemplify and clarify the operation of one example of the section locking mechanism 2154, attention is now directed both to the cross-section of FIG. 6 and also to the top view of the tool 2000 that is illustrated in FIG. 7. Noted is that some portions of the tool 2000 have been removed for clarity. More particular to the present example, however, it is seen that the inner interleaved section 2148 can comprise an opening 2168 with a plurality of apertures 2170 and a plurality of slots 2172. It is also shown in FIG. 7 that the outer interleaved section 2150 can comprise a bore 2174.

The apertures 2170 can extend through the material of the inner interleaved section 2148 to expose the inner portion of, e.g., the tubular member. The opening 2168 can be constructed so that the apertures 2170 are sized and shaped to receive the lower pin retainer 2158, although in certain embodiments of the tool 2000 the size of the apertures 2170 is only slightly larger than the size of the lower pin retainer 2158. This sizing can create a slight slip or loose fit as between the outer surface of the lower pin retainer 2158 and the inner surface of the apertures 2170. It may be desirable that this fit does not impeded movement of the lower pin retainer 2158.

The slots 2172, which can extend to one or more of the apertures 2170, can be sized and shaped in a manner that does not permit ingress of the lower pin retainer 2158. The slots 2172 can connect together the inner areas of the apertures 2170. This configuration creates a singular, elongated, open feature that is generally oriented along the longitudinal face of the inner interleaved section 2148. The bore 2174 can extend through the material of the outer interleaved section 2150. It can generally have dimensions that are the same that the apertures 2170. The bore 2174 can be positioned on the outer interleaved section 2150 so that it can substantially align with the opening 2168 when the interleaved sections 2146 are assembled together.

Discussing the interaction and cooperation of these features as they relate to the section locking mechanism 2154 in more detail, in one embodiment the locked position of the section locking mechanism 2154 occurs when the interleaved sections 2146 are in position to locate the bore 2174 in substantial coaxial alignment with one of the apertures 2170 of the opening 2168. The locked position is effectuated by ingress of the lower pin retainer 2158 into the apertures 2170. This ingress can be caused by the biasing spring 2162, which provides a spring force against the upper pin retainer 2160. The spring force, which can be directed substantially axially away from the midline 2144 of the tool 2000, positions at least a portion of the lower pin retainer 2158 in apertures 2170. Further movement of the lower pin retainer 2158 is limited, however, by contact with the outer interleaved section 2150 in areas at or around the bore 2174.

The unlocked position of the section locking mechanism 2154 can be effectuated by applying a force on the section locking mechanism 2154 in order to cause axial movement of the lower pin retainer 2158 toward the midline 2144 of the tool 2000. This can release the portion of the lower pin retainer 2158 from its engagement with the apertures 2170 and/or the bore 2174. In one embodiment, this disengagement permits the relative movement as between the inner interleaved section 2148 and the outer interleaved section 2150. In one example, the bore 2174 of the outer interleaved section 2150 can be aligned with another of the apertures 2170. The force can thereafter be removed, which permits the spring force of the biasing spring 2162 to cause the lower pin retainer 2158 to reengage with the apertures 2170 and the bore 2174.

Having set forth and discussed certain aspects of the handle part 2102 in embodiments of the tool 2000, attention is now turned to the tooling part 2104. More particularly, with reference now to the example in FIGS. 7 and 8, it is seen that each of the end effector receiving portions 2106 can also comprise an end effector receiving area 2176 that has an engagement feature 2178 such as a shape, a contour, or other feature that can be used to substantially support the end effector (e.g., end effector 1114 (FIGS. 1-4)) in the end effector receiving area 2176. The end effector receiving portions 2106 can also comprise a pair of lateral grooves 2180, a retaining hole 2182, and a retaining slot 2184, all of which can be used for securing the end effectors in the end effector receiving area 2176. The end effector receiving portions 2106 can also be constructed with an annular recess 2186 that forms a mating surface 2188 upon which opposing ones of the end effector receiving portions 2106 (e.g., the first end effector receiving portion 2108 and the second end effector receiving portion 2110) are mated such as when assembled together to form the tooling part 2102. The present example of FIGS. 8 and 9 also shows that the end effector receiving portions 2106 can comprise a leg extension 2190 with a shoulder 2192 and an elongated extension 2194 that extends away from the shoulder 2192.

The design of the engagement feature 2178 can vary, but should be consistent with similar features that are provided on the corresponding end effectors, such as those end effectors discussed below. In one embodiment, shapes and contours for the engagement feature 2178 can be selected so as to fully or partially engage complementary surfaces on the end effector. This engagement may prevent, eliminate, or redirect forces that are imparted on the end effector into portions of the multi-purpose tool. Likewise the configuration of the engagement feature 2178, in combination with the end effector retaining mechanism, can provide quick-release capabilities in which end effectors are readily replaceable in the tooling part 2104. This capability can permit the tool 2000 to be readily configured for different implementations.

The end effector receiving portions 2106, and particularly the elongated extension 2194 can be configured to be affixed to the handle part 2102. In one embodiment, the elongated extension 2194 can be sized and shaped to fit inside of an elongated member 2120 in a manner that permits the elongated member 2120 to fully seat against the shoulder 2192. The elongated extension 2194 in the present example is provided with a substantially rectangular cross-section, but this cross-section is not necessarily limiting to the present invention. Rather the selection of the cross-section can depend on the shape, style, and construction of the elongated member 2120. Likewise dimensions that define the outer surface of the elongated extension 2194 can be selected so as to permit the leg extension 2190 to fit inside the inner bore of the elongated member 2120, with such fit being provided as anywhere from a slight slip fit to a slight interference fit as desired.

Figures 10, 11:
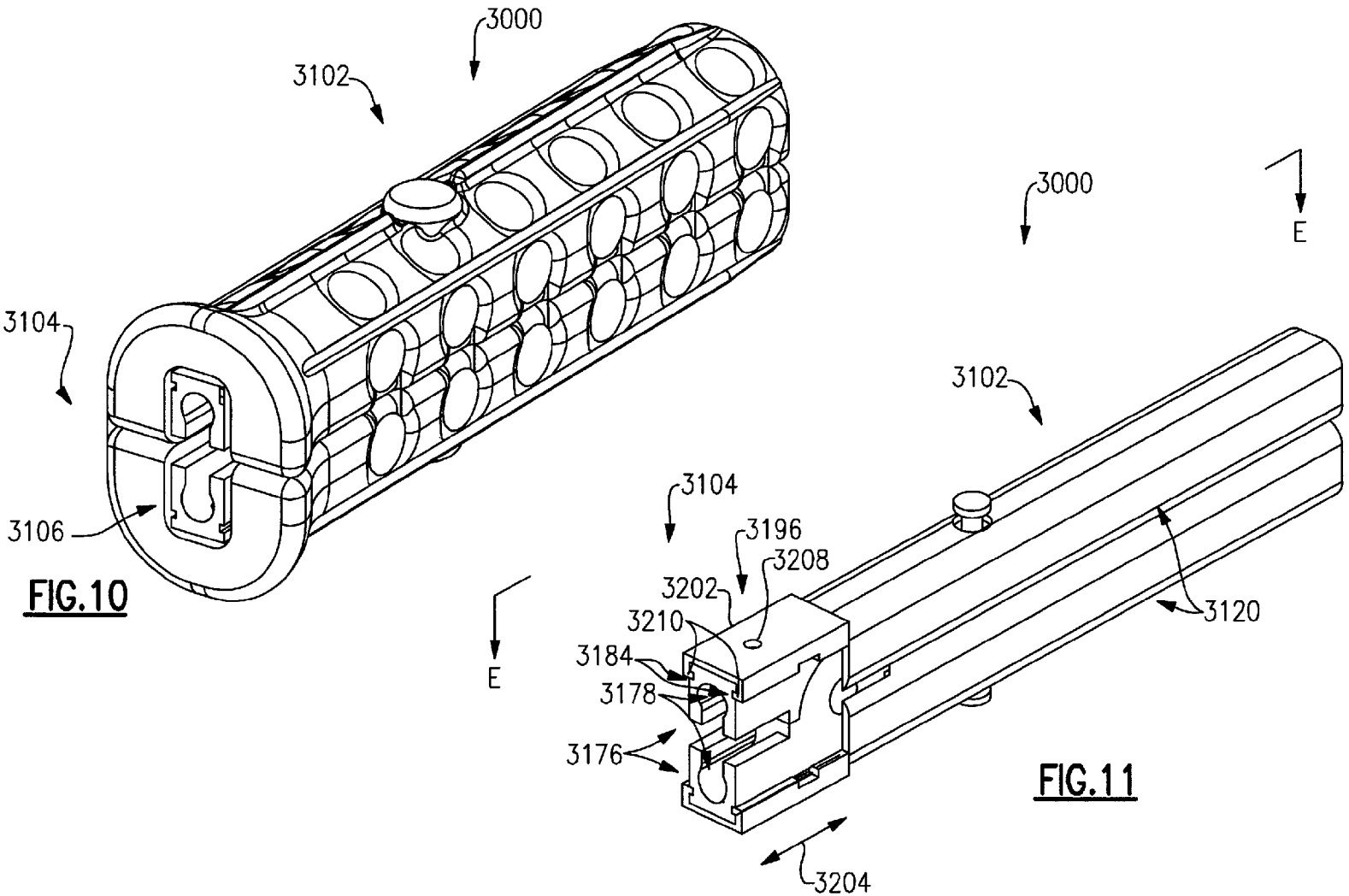
FIG. 10 is a front, perspective, assembly view of another exemplary embodiment of a tool made in accordance with the concepts of the present invention.
FIG. 11 is a front, perspective, partial assembly view of the tool of FIG. 10.
Figure 12:
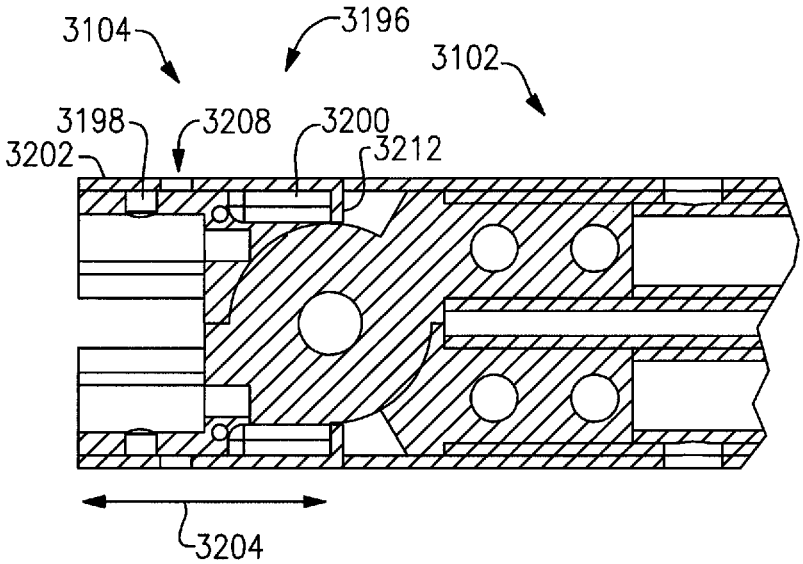
FIG. 12 is a side, cross-section, assembly view of the tool of FIG. 11.
Figure 13:
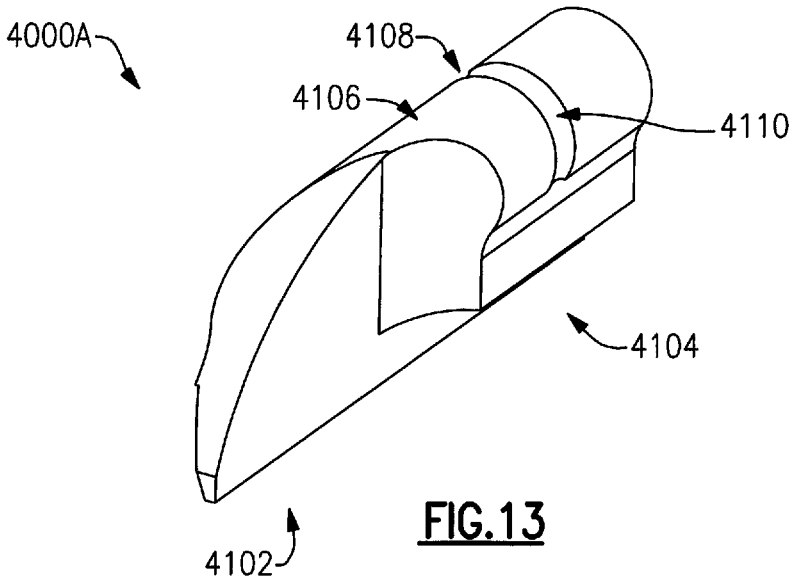
FIG. 13 is a perspective view of one example of end effector for use with a multi-purpose tool such as the multi-purpose tools of FIGS. 1-4.

Referring now to FIGS. 10-12, there is provided another exemplary embodiment of a tool 3000 that is made in accordance with the concepts disclosed herein. Like numerals are used to identify like components as between tool 2000 (FIGS. 5-9) and tool 3000, but the numerals are increased by 1000 (e.g., 2000 is now 3000). More particular to the present example, and as is best illustrated in FIG. 10, the tool 3000 can comprise a handle part 3102, a tooling part 3104 with end effector receiving portions 3106. The tool 3000 is shown in a hand grip configuration, which is similar to the hand grip configuration A of FIGS. 1-4 illustrated and described above.

With reference to FIGS. 11-12, in which some components of the tool 3000 are removed for clarity, there is shown that embodiments of the tool 3000 can comprise an end effector retaining mechanism 3196 for releasable securing of the end effectors (e.g., end effector 1114 (FIGS. 1-4)) to embodiments of the tool 3000. The end effector retaining mechanism 3196 can comprise a ball 3198, a retaining spring 3200 such as a compression spring, and a slide 3202 actuatable in a slide direction 3204, all of which can be assembled to one or both of the end effector receiving portions 3106. The slide 3202 can comprise a slide body 3206 with a ball aperture 3208, slot engaging features 3210, and a spring engaging feature 3212 for engaging the retaining spring 3200.

The ball 3198 can have a size and shape configured to engage one or more complimentary features of the end effector when the end effector is inserted into the end effector receiving area 3176. This shape can be generally spherical, as illustrated in the present embodiment of the tool 3000, or the shape can be configured with certain spherical portions as desired. The ball can be constructed of materials compatible with the materials used to construct other part so the tool 3000, with material in one construction being selected with properties resistant to substantial wear and friction consistent with repeated abrasion from the insertion and removal of the end effectors.

The slide 3202 can also be constructed of such resilient materials such as steel, stainless steel, aluminum, and the like. The slide 3202 can be constructed monolithically, such as if being machined or extruded from such material using common manufacturing techniques. The slot engaging features 3210 are generally sized and shape to be received in the corresponding retaining slots 3184. The fit desired between these two components can be a generally slip fit, which in the present example can permit the slide 3202 to move in the slide direction 3204.

The end effector retaining mechanism 3196 can be generally configured to secure the end effectors to the end effector receiving portions 3106. In one embodiment, the slide 3202, the ball 3198, and the retaining spring 3200 can act in conjunction with one another to cause the ball 3198 to engage corresponding features of end effectors for use with tool 3000. The user can cause the slide 3202 to move in the slide direction 3204 so that the ball aperture 3208 aligns substantially with the ball 3198. The end effector can then be inserted (or removed), an action that can force the ball 3198 towards the ball aperture 3208 until the portion of the end effector with such complimentary feature is aligned with the ball 3198. This complimentary feature will receive the ball 3198, and in one example the ball 3198 is caused to engage the complimentary feature when the slide 3202 is moved along the slide direction 3204 so that the ball aperture 3208 is no longer aligned with the ball 3198.

For examples of this complimentary feature, as well as other features of end effectors of the present invention, reference is now turned to FIGS. 13-18, in which exemplary end effectors 4000A-E are illustrated. Each of the end effectors 4000A-E is compatible with the embodiments of the tool 1000, 2000, 3000 of the present disclosure. For example, there is provided in the FIGS. 13-18 end effectors 4000A-E that can comprise a working end 4102 and an end effector adaptor end 4104 with an outer contoured surface 4106. These features can be constructed unitarily, or these features can be found on a plurality of individual components that are assembled together to form the end effectors (e.g., end effectors 4000A-E). Each of the end effectors can be constructed of a variety of materials and using a variety of manufacturing. Machining, turning, casting, and extruding are but a few of the contemplated means and processes for producing end effectors such as those illustrated in the FIGS. 13-18. Likewise materials used to construct each can be selected based on the particular implementation for which the end effector is designed. This selection can include, but is not limited to, hardened materials, composites, as well as combinations and compositions (including exotic combinations) formulated for its certain physical property, chemical property, or other characteristics.

The working end 4102 is provided to configure the tool for the particular implementation. Illustrated in the FIGS. 13-18 are end effectors with working end 4102 for cutting implementations (e.g., end effector 4000A), hammer implementations (e.g., end effector 4000B), pliers implementations (e.g., end effector 4000C), screw driver implementations (e.g., end effector 4000D), and rail engagement implementation (e.g., end effector 4000E). This is not, of course, an exhaustive list.

With continued reference to FIGS. 13-18, and also FIGS. 5-12, the end effector adapter end 4104 is configured to mate with, and fit into the engagement feature 2178, 3178 of the tooling part 2104, 3104. That is the outer contoured surface 4106 can be sized and shaped so as to permit the end effector adapter end 4104 to fit snugly (e.g., a slight slip fit) into the engagement feature 2178, 3178. In one embodiment, the end effector adapter end 4104 may also comprise a complimentary feature 4108 that is compatible with one or more parts of the end effector retaining mechanism discussed above. This complimentary feature 4108 may be a detent, recess, shoulder, or other feature that is provided so that the retaining mechanism (e.g., the end effector retaining mechanism 3196) on the tooling part can secure the end effector inside of the engagement feature 2178, 3178. As it is illustrated in the present examples, the complimentary feature 4108 comprises a detent 4110 for use with receiving the corresponding pin/ball (e.g., the ball 3198) of the end effector retaining mechanism disclosed herein.

Figure 14:
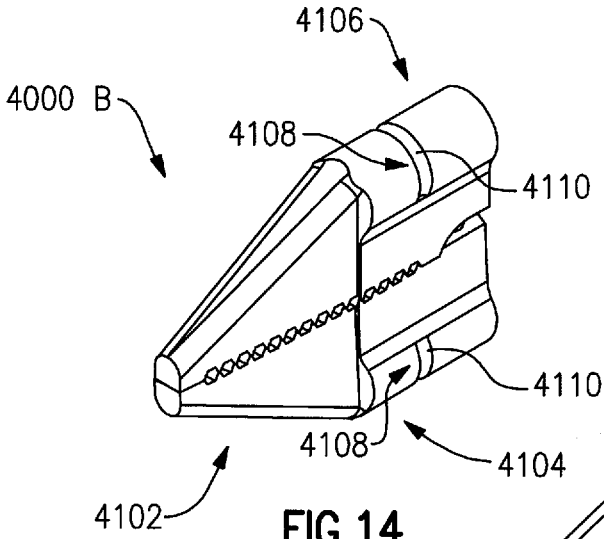
FIG. 14 is a perspective view of another example of end effector for use with a multi-purpose tool such as the multi-purpose tools of FIGS. 1-4.
Figure 15:
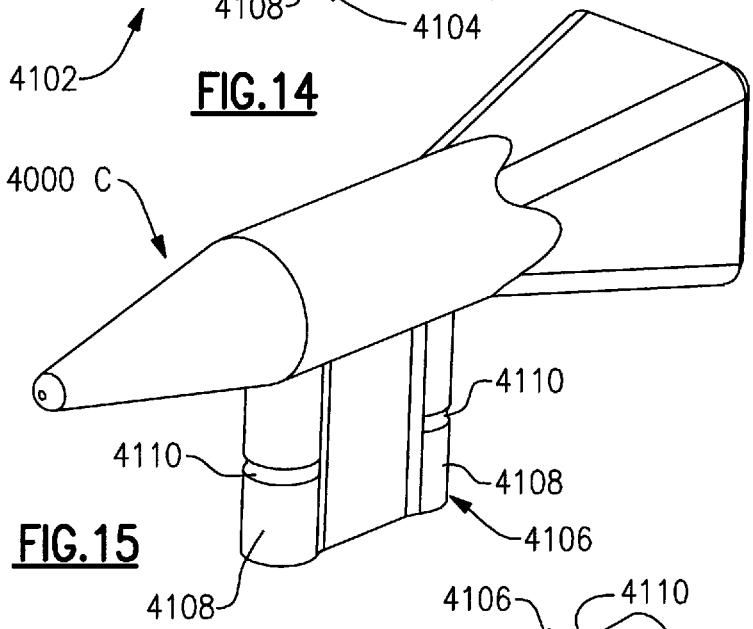
FIG. 15 is a perspective view of yet another example of end effector for use with a multi-purpose tool such as the multi-purpose tools of FIGS. 1-4.
Figure 16:
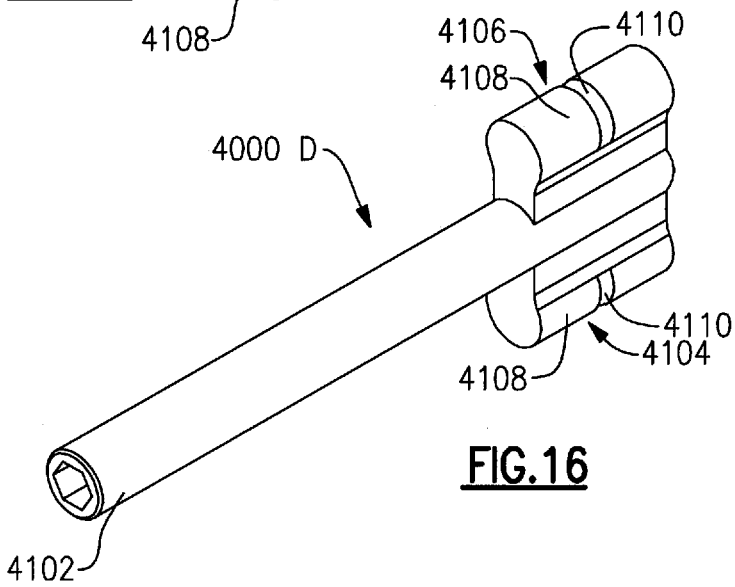
FIG. 16 is a perspective view of still another example of end effector for use with a multi-purpose tool such as the multi-purpose tools of FIGS. 1-4.

In another embodiment, and with particular reference to the end effector 4000C-D of FIGS. 14 and 15, it is seen that the end effector adapter end 4104 can be configured to fit simultaneously into the engagement feature 2178, 3178 on both of the end effector receiving portions 2106, 3106. This design locks the elongated member 2120, 3120 adjacent to one another, and in one construction the elongated member 2120, 3120 can not be angularly displaced relative to one another until the end effector (e.g., end effector 4000C-D) is removed from the engagement feature 2178, 3178. In another embodiment, but not necessarily illustrated in the figures of the present application, the end effector adapter end 4104 may be constructed in such a way as to lock the elongated member 2120, 3120 at an angle with respect to one another or other portion of the tool (e.g., the midline 2144).

Figure 17:
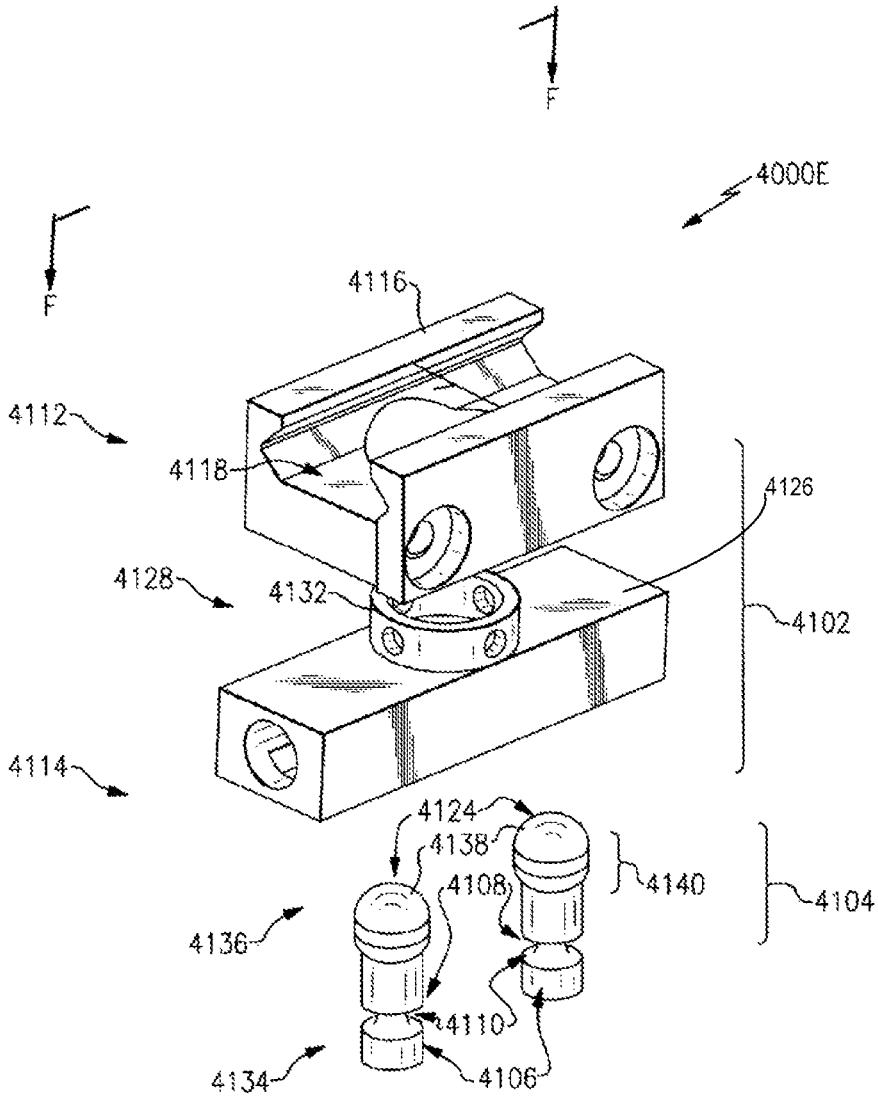
FIG. 17 is a side, perspective, exploded assembly view an end effector for use with the tools such as the tools of FIG. 1-12.
Figure 18:
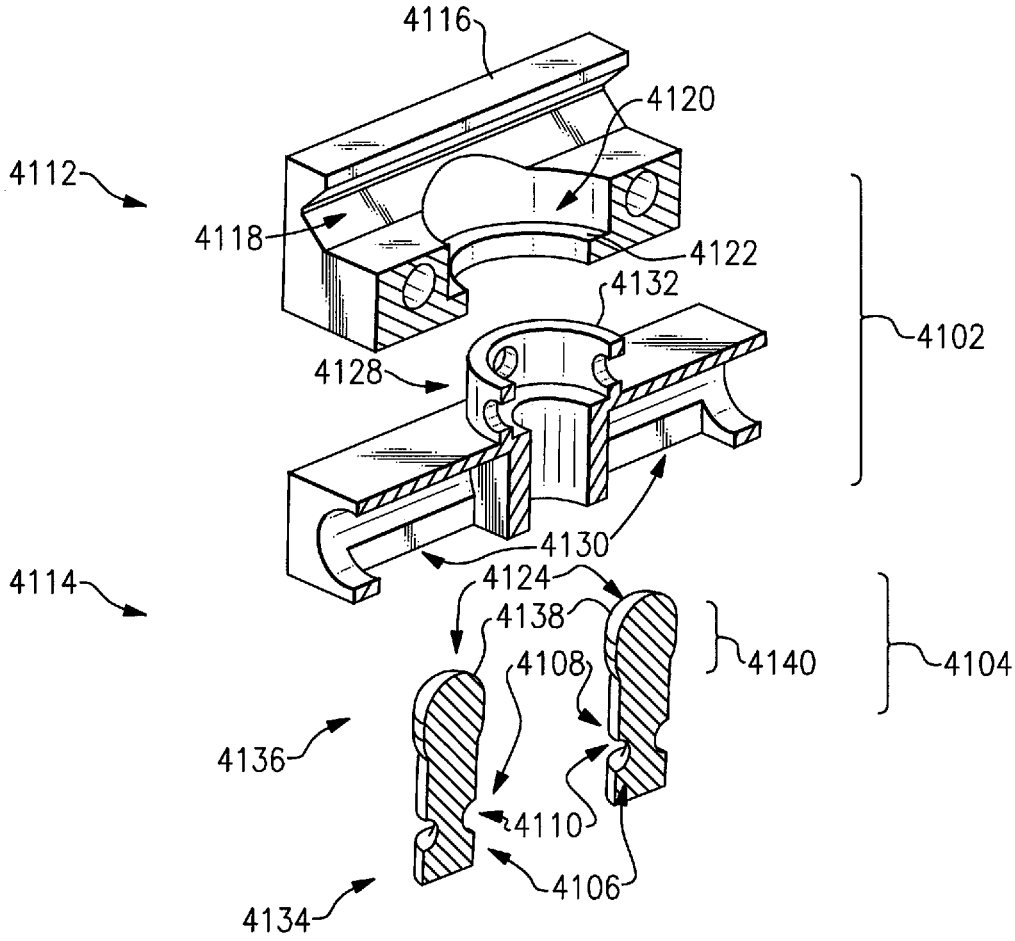
FIG. 18 is a side, cross-section, perspective, exploded assembly view of the end effector of FIG. 17.

Referring now to FIGS. 17-18, there is illustrated the end effector 4000E, which is compatible with and easily secured to the rail (e.g., rail 1110) of a firearm (e.g., firearm 1108). As discussed in connection with the end effectors 4000A-D, the end effector 4000E can comprise a working end 4102, an end effector adaptor end 4104 with an outer contoured surface 4106, and a complimentary feature 4108 such as a detent 4110. The end effector 4000E can further comprise a rail interface 4112 (e.g., rail interface 1116 (FIGS. 1-4)) and a tool interface 4114 (e.g., tool interface 1118 (FIGS. 1-4)). The rail interface 4112 can comprise a rail engagement device 4116 that forms or has incorporated therein a rail engagement feature 4118, which can be secured to the rail of the firearm. The rail engagement device 4116 can also comprise a bore opening 4120 that forms a shelf 4122 such as could be formed with a counter bore or similar manufacturing technique.

The tool interface 4114 can comprise a pair of insertion pins 4124, and a rotatable portion 4126 that forms a joint 4128 and a pair of slots 4130. In one embodiment, the joint 4128 can comprise a boss 4132 that extends outward from the rotatable portion 4126. The boss 4132 can be sized and shaped to fit through and be rotatable about the bore opening 4120 of the rail engagement device 4116. In one example, the boss 4132 can include features that engage the shelf 4122 in a manner supporting the tool interface 4114 from the rail interface 4112. While a variety of features can be used, exemplary features can comprise pins, bearings, and surfaces that are configured to engage the shelf 4122, but permit relative movement and particularly relative rotation of the rail interface 4112 and the tool interface 4114.

The insertion pins 4124 can comprise a tool end 4134 and a slot end 4136 that can comprise a substantially rounded portion 4138 and an elongated body 4140 that extends between the rounded portion 4138 and the tool end 4134. The tool end 4134 as indicated in the FIGS. 17-18 are generally configured to engage the end effector receiving portions (e.g., the end effector receiving portions 2106, 3106) as disclosed and described herein. The slot end 4136, and more particular the rounded portion 4138 can be sized and shaped to engage the interior of the tool interface 4114. Likewise the elongated body 4140 can be generally cylindrical with dimensions selected so that the elongated body 4140 can move freely within the slots 4130 such as when the tool is configured in the bi-pod configuration C of FIGS. 1-4 above.

In view of the foregoing, embodiments of the tool 1000, 2000, 3000 can be combined with one or more of end effectors 4000A-E to form a tool kit. This tool kit can also comprise a housing such a flexible or non-flexible enclosure in which his housing the tool and end effectors. The mix of the end effectors that are found in the tool kit can be selected for one or more of the implementations, with one construction of the tool kit being so configured to accommodate at least the rail engagement implementation. Other constructions of the tool kit can likewise accommodate an of the other implementations discussed herein, as well as combinations and derivations thereof.

It is contemplated that numerical values, as well as other values that are recited herein are modified by the term "about", whether expressly stated or inherently derived by the discussion of the present disclosure. As used herein, the term "about" defines the numerical boundaries of the modified values so as to include, but not be limited to, tolerances and values up to, and including the numerical value so modified. That is, numerical values can include the actual value that is expressly stated, as well as other values that are, or can be, the decimal, fractional, or other multiple of the actual value indicated, and/or described in the disclosure.

While the present invention has been particularly shown and described with reference to certain exemplary embodiments, it will be understood by one skilled in the art that various changes in detail may be effected therein without departing from the spirit and scope of the invention as defined by claims that can be supported by the written description and drawings. Further, where exemplary embodiments are described with reference to a certain number of elements it will be understood that the exemplary embodiments can be practiced utilizing either less than or more than the certain number of elements.

What is claimed is:

1. A tool for receiving an end effector, comprising:

first and second elongated handle portions comprising a primary tubular member, a secondary tubular member inside of the primary tubular member, and a grip portion secured to the primary tubular member;

an end effector for securing the elongated handle members to a firearm, the end effector comprising a rail interface and a tool interface coupled to the rail interface;

an end effector receiving portion coupled to each of the first and second elongated handle portions; and a pivot coupling the end effector receiving portions in a manner effectuating rotation of the end effector receiving portions about the pivot in response to movement of the first elongated handle portion with respect to the second elongated handle portion, wherein the grip portion comprises a bottom surface located a distance from the pivot, wherein the secondary tubular member is moveable with respect to the primary tubular member to permit the grip portion to move to a first position and a second position, and wherein the distance between the bottom surface and the pivot in the first position is different from the distance between the bottom surface and the pivot in the second position.

2. A tool according to claim 1, wherein the end effector receiving portions comprise an end effector retaining mechanism for securing the end effector to the first and second end effector receiving portions, wherein the end effector retaining mechanism comprises a slide, a ball, and a spring disposed in the end effector receiving portion, and wherein the spring biases the slide so that the ball engages the end effector.

3. A tool according to claim 1, wherein the grip portion comprises an opening opposite of the bottom surface, and wherein the opening is sized and shaped to receive the end effector receiving portions in the first position so that each of the end effector receiving portions are recessed into the handle body.

4. A tool according to claim 1, wherein the grip portion comprises a gripping surface that has a plurality of indentations.

5. A tool according to claim 4, wherein the grip portion comprises an actuator and a section release mechanism coupled to the actuator, where the section release mechanism is configured to releasably secure the primary tubular member to the secondary tubular member at one of the first position and the second position.

6. A tool according to claim 5, wherein the actuator is integrated into the gripping surface.

7. A multi-purpose tool according to claim 1, wherein the primary tubular member comprises a first hollow tube that has an interior opening sized and shaped to receive an elongated extension of the end effector receiving portion therein.

8. A tool according to claim 1, wherein the primary tubular member surrounds the secondary tubular member.

9. A hand grip for a firearm, comprising:

a handle body comprising first and second grip portions;

a pair of elongated handle members each supporting one of the first and second grip members, the elongated handle members comprising interleaved sections with an inner interleaved section and an outer interleaved section;

an end effector for securing the elongated handle members to the firearm, the end effector comprising a rail interface and a tool interface coupled to the rail interface;

an end effector receiving portion secured to the inner interleaved section; and a pivot coupling each of the end effector receiving portions in a manner effectuating rotation of the end effector receiving portions about the pivot in response to movement of the elongated handle members, wherein the first and second grip portions comprise a bottom surface located a distance from the pivot, and wherein the first interleaved section is moveable with respect to the second interleaved section to permit the first and second grip portions to move to a first position and a second position, and wherein the distance between the bottom surface and the pivot in the first position is different from the distance between the bottom surface and the pivot in the second position.

10. A hand grip according to claim 9, further comprising a section locking mechanism secured to each of the elongated handle members, wherein the section locking mechanism comprises a lower pin retainer that engages one or both of the interleaved sections in a manner that prevents movement from the first position to the second position.

11. A hand grip according to claim 9, wherein, the tool interface is configured for receiving a plurality of insertions pins, and wherein each of the insertion pins has a tool part secured to the end effector receiving portion.

12. A hand grip according to claim 11, wherein the end effector causes the elongated handle members to separate about a midline.

13. A hand grip according to claim 11, wherein the rail interface of the end effector is configured to attach to a Picatinny rail.

14. A hand grip according to claim 9, wherein the inner and outer interleaved sections comprise hollow, tubular members, and wherein the outer interleaved section fully surrounds the inner interleaved section.

15. A hand grip according to claim 9, wherein the end effector receiving portion comprises an end effector release mechanism for securing an end effector therein, wherein the end effector release mechanism comprises a ball, a slide, and a spring in communication with the end effector receiving portion, and wherein the spring biases the slide so that the ball engages the end effector.

16. A tool kit comprising:

a tool comprising, a tool part comprising a first end effector receiving portion, a second end effector receiving portion, and a pivot rotatably coupling the first end effector receiving portion and the second end effector receiving portion, and a handle part coupled to the tool part, the handle part comprising a first handle portion and a second handle portion, one each coupled to the first and second end effector receiving portions in a manner effectuating rotation of the first and second end effector receiving portions about the pivot in response to movement of the first handle portion with respect to the second handle portion, wherein each of the first and second handle portions comprise a handle body that has a bottom surface located a distance from the pivot, and wherein the handle body is moveable to a first position and a second position so that the distance between the bottom surface and the pivot in the first position is different from the distance between the bottom surface and the pivot in the second position; and an end effector comprising a rail interface and a tool interface coupled to the rail interface, and an end effector adapter end for engaging an engagement feature of the end effector receiving portions, wherein the end effector comprises a working end operative for one or more implementations.

17. A tool kit according to claim 16, wherein the implementations comprise one or more of a cutting implementation, a hammer implementation, a screw driver implementation, and a pliers implementation.

18. A tool kit according to claim 17, wherein each implementation comprises a different one of the end effector.

* * * * *